US007264211B2

(12) United States Patent
Lindner et al.

(10) Patent No.: US 7,264,211 B2
(45) Date of Patent: Sep. 4, 2007

(54) ADJUSTABLE CLIP

(75) Inventors: Leonard S. Lindner, Hudson, OH (US); James M. Cisar, Wadsworth, OH (US); Daniel Johnson, Canton, OH (US)

(73) Assignee: Cisco Technology, Inc., San Jose, CA (US)

( * ) Notice: Subject to any disclaimer, the term of this patent is extended or adjusted under 35 U.S.C. 154(b) by 290 days.

(21) Appl. No.: 10/995,892

(22) Filed: Nov. 23, 2004

(65) Prior Publication Data

US 2006/0112659 A1 Jun. 1, 2006

(51) Int. Cl.
*A47B 96/06* (2006.01)

(52) U.S. Cl. ..... 248/220.21; 248/221.11; 403/80; 403/326

(58) Field of Classification Search ..... 248/220.22, 248/221.11, 222.11, 225.11, 222.12, 220.21; 403/321, 326, 340, 388, 61, 80; 52/665, 52/667, 668
See application file for complete search history.

(56) References Cited

U.S. PATENT DOCUMENTS 2,891,757 A * 6/1959 Lang ..... 248/225.11
3,297,345 A * 1/1967 Downing, Jr. ..... 403/326
3,545,712 A * 12/1970 Ellis ..... 248/222.11
4,053,246 A * 10/1977 Uccello ..... 403/233
4,148,454 A * 4/1979 Carlson et al. ..... 248/222.11
4,236,642 A * 12/1980 Klein ..... 211/207
4,314,432 A * 2/1982 Rosenbaum ..... 52/506.07
4,705,255 A 11/1987 Reed, Jr.
5,127,577 A 7/1992 Lynch, Jr. et al.
5,148,981 A 9/1992 Lynch, Jr. et al.
5,966,893 A * 10/1999 Quillin ..... 52/713
6,761,341 B2 7/2004 Pfaller

OTHER PUBLICATIONS

Cooper B-Line, Acoustical Tee, pp. 69-72.
http://www.erico.com/products.asp?folderid=110, ERICO, Acoustical.

* cited by examiner

*Primary Examiner*—A. Joseph Wujciak, III
(74) *Attorney, Agent, or Firm*—Tucker Ellis & West LLP

(57) ABSTRACT

An adjustable clip having a first clip member and a second clip member. The first clip member includes a first slide tang that includes a first end, a second end with a detent tang. The second clip member includes a second slide tang having a first end, a second end with a detent tang. The slide tangs of the first and second clip members are positioned over the rail for installation and the slide tangs are moved towards each other until the detent tangs of the first and second clip members engage opposing ends of the rail.

12 Claims, 10 Drawing Sheets

ADJUSTABLE CLIP

BACKGROUND

The present invention is directed to an adjustable clip. More particularly, the present invention is directed to a mounting clip and method for use with a suspended ceiling structure.

In the typical wireless network environment, devices such as wireless routers, or access points, are affixed to ceilings. The access points are attached to the ceilings of businesses for a variety of reasons, including avoidance of damage to the unit. Access points placed on the ground are subjected to various hazards, resulting in damage to the unit, or loss of signals as the unit and/or connecting wires are trampled. The attachment of access points to ceilings presents additional difficulties. A variety of different ceiling types are employed by businesses, including drop-down ceiling tiles. The typical drop down ceiling employs a network of T-rails, which are first emplaced, hanging from original ceiling of a room and ceiling tiles are installed resting on the T-rails. An access point can be mounted on the T-rail by using a clip that grips opposing ends of the T-rails. However, currently there are three popular sizes of T-rails for ceiling tiles. Accordingly, each size T-rail size requires a different size clip. Therefore a vendor normally has to include at least three clips for ceiling mounted devices, such as access points, that are to be affixed to a T-rail of a drop ceiling, or other similar mounting.

SUMMARY OF INVENTION

In view of the aforementioned needs, there is contemplated an adjustable clip and method capable of being implemented on a variety of existing ceiling structures. More particularly, the present invention is directed to adjustable clip for mounting a device to a drop-down ceiling structure. The present invention is directed to a method for mounting a device to a drop-down ceiling structure using an adjustable clip.

In accordance with the present invention, there is provided an adjustable clip. The adjustable clip includes a first clip member and a second clip member. The first clip member includes a first slide tang that includes a first end, a second end and a detent tang disposed on the second end of the slide tang. The second clip member includes a second slide tang having a first end and a second end, and a detent tang disposed on the second end of the slide tang. The first end of the slide tang of the first clip member engages the detent tang of the second clip member and the first end of the slide tang of the second clip member engages the detent tang of the first clip member.

In a preferred embodiment, the adjustable clip includes a U shaped member extending from the detent tang of the first clip member such that the U shaped member is substantially parallel to the longitudinal axis of the slide tang of the first clip member. The adjustable clip also includes a U shaped member extending from the detent tang of the second clip member such that the U shaped member is substantially parallel to the longitudinal axis of the slide tang of the first clip member.

In an alternative embodiment, the adjustable clip further comprises a vertical arm coupling the U shaped member of the first clip member to the second end of the slide tang of the first clip member. Additionally, the adjustable clip includes a second vertical arm coupling the U shaped member of the second clip member to the second end of the slide tang of the second clip member.

Further in accordance with the present invention, there is provided an adjustable clip having a first clip member and a second clip member. The first clip member has a slide tang with first and second ends. The second clip member has a slide tang with first and second ends. The first clip member further includes means adapted for receiving the slide tang of the second clip member. The second clip member further comprises means adapted for receiving the slide tang of the first clip member.

Still further, in accordance with the present invention, there is provided an adjustable clip. The adjustable clip includes a first clip member and a second clip member. The first clip member includes a slide tang having a first end and a second end, and a detent tang disposed on the second end of the side tang. The second clip member includes a slide tang having a first end and a second end, and a detent tang disposed on the second end of the side tang. The adjustable clip also includes a first tab disposed on the first end of the first slide tang and a second tab disposed on the first end of the second slide tang. The adjustable clip further includes a U shaped member extending from the second end of the slide tang of the first clip member such that the U shaped member is substantially parallel to the longitudinal axis of the slide tang of the first clip member. In addition, the adjustable clip includes a U shaped member extending from the second end of the slide tang of the second clip member such that the U shaped member is substantially parallel to the longitudinal axis of the slide tang of the first clip member. The first end of the slide tang of the first clip member engages the detent tang of the second clip member and the first end of the slide tang of the second clip member engages the detent tang of the first clip member. The first tab prevents the slide tang of the first clip member from disengaging the detent tang of the first clip member and the second tab prevents the slide tang of the second clip member from disengaging the detent tang of the first clip member. The U shaped member extending from the second end of the slide tang of the first clip member is adapted to engage one side of a T-rail. The U shaped member extending from the second end of the slide tang of the second clip member is adapted to engage the opposing side of the T-rail.

Still other aspects of the present invention will become readily apparent to those skilled in this art from the following description wherein there is shown and described a preferred embodiment of this invention, simply by way of illustration of one of the best modes suited for to carry out the invention. As it will be realized, the invention is capable of other different embodiments and its several details are capable of modifications in various obvious aspects all without departing from the invention. Accordingly, the drawing and descriptions will be regarded as illustrative in nature and not as restrictive.

BRIEF DESCRIPTION OF THE DRAWINGS

The accompanying drawings incorporated in and forming a part of the specification, illustrates several aspects of the present invention, and together with the description serve to explain the principles of the invention. In the drawings:

FIG. 1, comprising

FIG. 1A is a top view of the clip member;

FIG. 1B is a front to rear view of the clip member;

FIG. 1C is a side view of the clip member;

FIG. 1D is a isometric view of the top side of the clip member; and

FIG. 1E is an isometric view of the bottom side of the clip member.

FIG. 5, comprising

FIG. 5A shows the adjustable clip with the members aligned prior to engaging the slide tangs with the detent tangs;

FIG. 5B shows the adjustable clip with the slide and detent tangs engaged in an open position;

FIG. 5C shows the adjustable clip with in the closed position; and

FIG. 5D shows the adjustable clip in the closed position and illustrating where set screws can be inserted.

FIG. 7 comprising

FIG. 7A is a top view of the clip member;

FIG. 7B is a front to rear view of the clip member;

FIG. 7C is a side view of the clip member;

FIG. 7D is a isometric view of the top side of the clip member; and

FIG. 7E is an isometric view of the bottom side of the clip member.

DETAILED DESCRIPTION OF THE PREFERRED EMBODIMENT

Figure 1C:
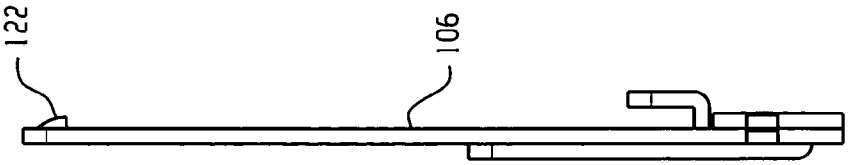
FIGS. 1A-1E illustrates an clip member suitable for use with the adjustable clip of the present invention.
Figure 1B:
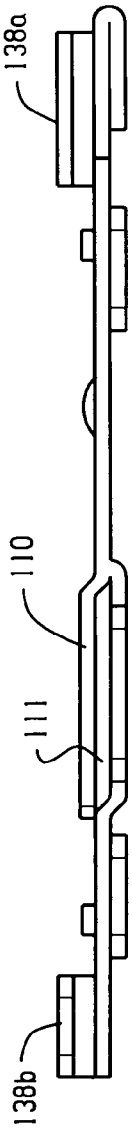
Figure 1A:
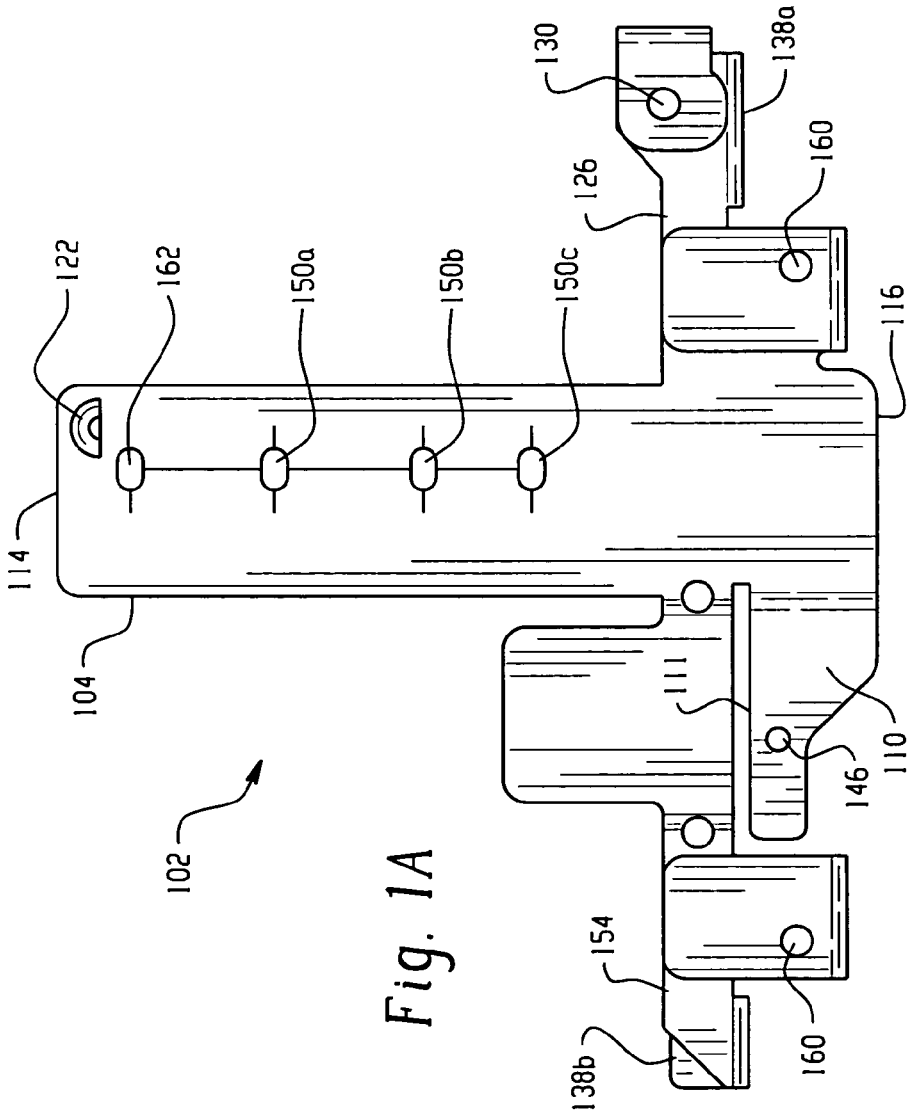
Figure 1D:
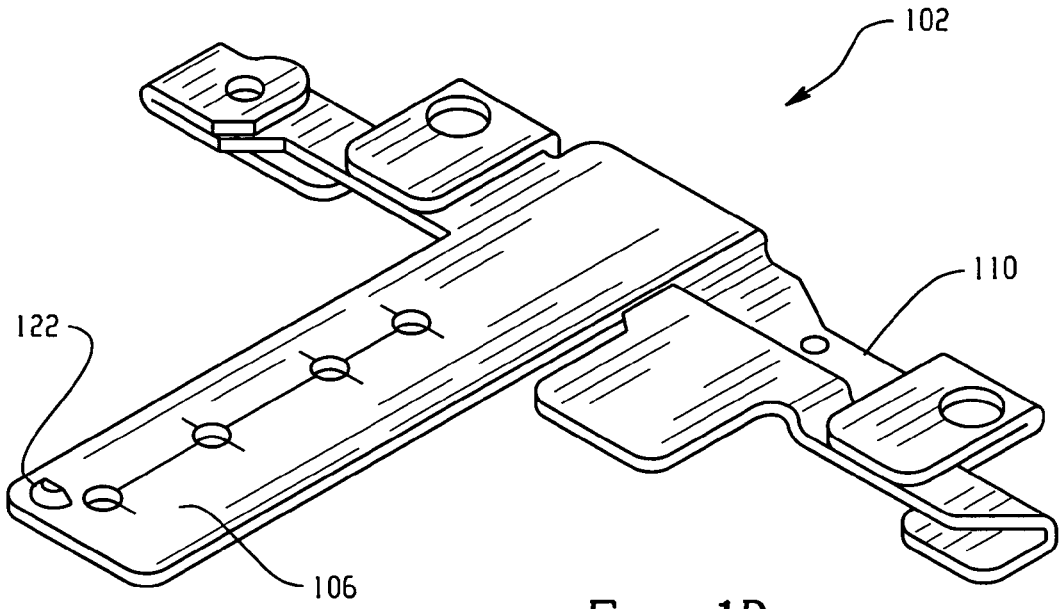
Figure 1E:
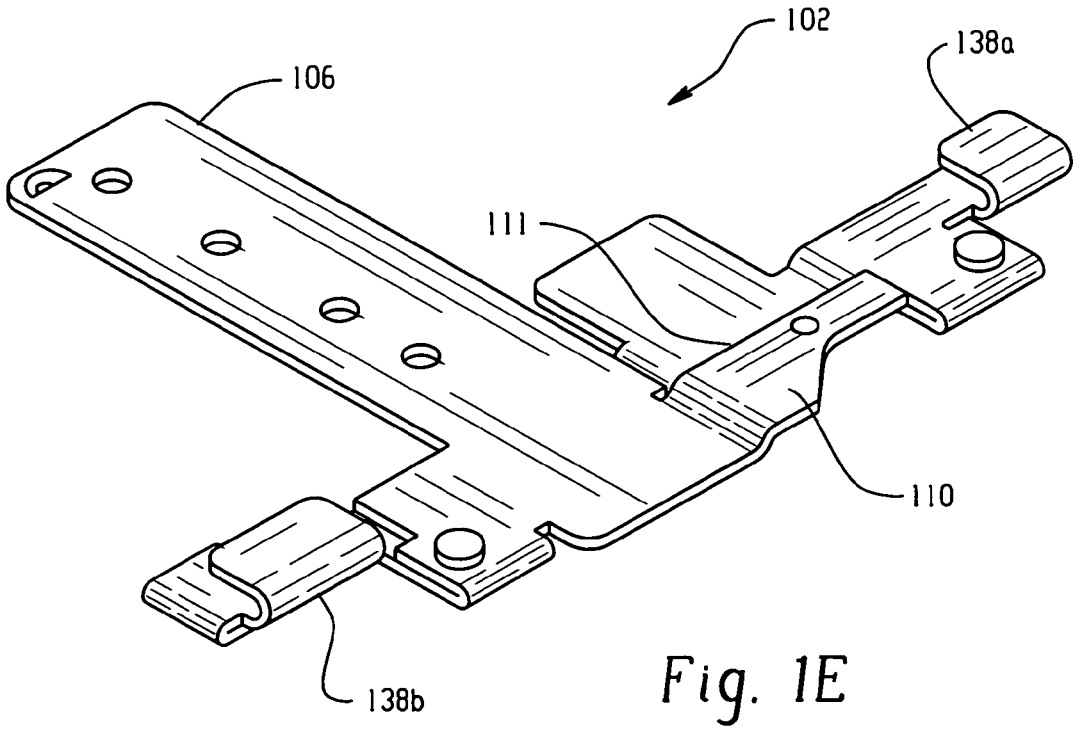

As will be appreciated by those skilled in the art, the adjustable clip of the present invention is suitably adapted for securing a device to a railing such as are used by a drop-down ceiling structure by securely attaching the clip to opposing sides of the T-rails of the drop-down ceiling structure. As is known in the art, typical ceiling T-rails are one of 9/16, 15/16 and 1-½ inches wide. The skilled artisan will appreciate that the present invention is not limited to attachment to ceiling T-rails of aforementioned widths and is suitably adaptable to other widths.

Referring now to FIG. 1 there is shown a clip member 102 of the adjustable clip of the present invention. The first clip member 102 is comprised of a slide tang 106 and a detent tang 110. Detent tang 110 has an opening 111 that is of suitable width and height for engaging the slide tang of a second clip member (not shown in FIG. 1, see for example FIG. 3). Slide tang 106 has a first end 114 and a second end 116. Detent tang 110 is located at the second end 116 of slide tang 106. In the preferred embodiment, the adjustable clip 100 is suitably comprised of 0.047" thick hot-dip galvanized steel, pre-plated, with minimum spangle, extra smooth coat and edge treatment. The skilled artisan will appreciate that the adjustable clip 100 is capable of employing different material, such as aluminum, at varying thickness and the use of steel herein is for exemplification only. Slide tang 106 includes a tab 122.

The first clip member 102 also includes a U shaped member 138*a* coupled to arm 126 that extends from the second end 116 of the slide tang 106. The U shaped member 138*a* is substantially parallel to the longitudinal axis of the slide tang 106 of the first clip member 102. An aperture 130 suitably extends through the top portion of the U shaped member 138*a*, to allow the set-screw to engage the T-rail of the drop down ceiling structure. A second U shaped member 138*b* is coupled to an arm 154 extending on the same plane, but in the opposite direction of arm 126 disposed on the second end 116 of the first clip member 102. The U shaped member 138*b* is substantially parallel to the longitudinal axis of the slide tang 106 of the first clip member 102.

As will be understood by those skilled in the art, the width of the U shaped members 138*a-b* is suitably larger than the width of the rail so as to engage the rail. It will be appreciated by those skilled in the art that the gap parallel extensions of the U shaped members 138*a-b*, i.e., the open end, in a preferred embodiment is suitably 0.09 inches in width apart. The skilled artisan will appreciate that the U shaped members 138*a-b*, are adapted to receive the rail of the ceiling structure and are capable of employing gaps of different widths, without departing from the scope of the present invention.

As illustrated in FIG. 1, the detent tang 110 of the first clip member 102 includes a nipple 146. Slide tang 106 also includes three holes 150*a-c*, which correspond to a predetermined rail width. Additionally, mounting holes 160 are suitably adapted for engaging a device (not shown) that is to be mounted onto the clip. For example, mounting holes 160 can be used to mount an access point, wireless switch or other device onto clip 100 when clip 100 is engaging a rail, such as a ceiling T-rail. Hole 162 is used for holding the clip in an open position.

Figure 2:
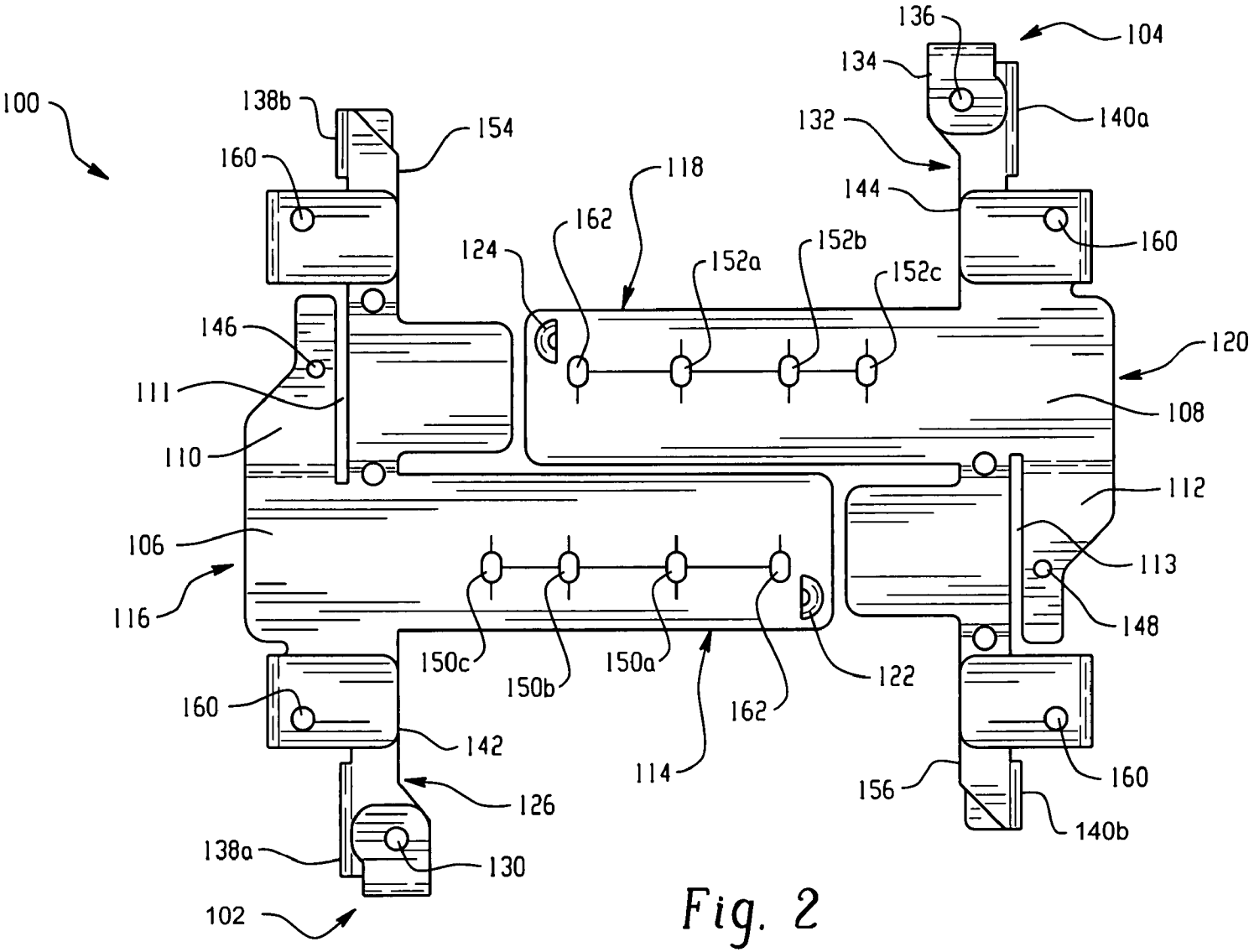
FIG. 2 illustrates the adjustable clip with the clip members disengaged.

Referring now to FIG. 2, with continued reference to FIG. 1, there is shown a preferred embodiment of the adjustable clip 100 of the present invention. As illustrated in FIG. 1, the adjustable clip includes a first clip member 102 and a second clip member 104. As shown in FIG. 2, the first clip member 102 and second clip member 104 are substantially identical, however, any substantially symmetrical arrangement of slide tangs 106, 108 and detent tangs 110, 112 can be suitably adapted. First clip member 102 is comprised of a slide tang 106 and a detent tang 110. Second clip member 104 also is comprised of a slide tang 108 and a detent tang 112. As shown in FIG. 1, the slide tang 106 of the first clip member 102 has a first end 114 and a second end 116, the detent tang 110 of first clip member 102 is located at the second end 116 of slide tang 106. The slide tang 108 of the second clip member 104 includes first end 118 and a second end 120, the detent tang 112 of the second clip member 104 being at the second end 120 of the slide tang 108. As will be appreciated by those skilled in the art, the first end 114 of the slide tang 106 of the first clip member 102 engages the detent tang 112 of the second clip member 104 by sliding through an opening 113 of detent tang 112, and the first end 118 of the slide tang 108 of the second clip member 104 engages the detent tang 110 of the first clip member 102 by sliding through opening 111 of detent tang 110.

As illustrated in FIG. 2, slide tang 106 of first clip member 102 suitably includes a tab 122 disposed on detent tang 110 of first clip member 102. It will be understood by the skilled artisan that tab 122 suitably engages the detent tang 112 of the second clip member 104 when the first clip member 102 and the second clip member 104 are at the maximum displacement from each while engaged. Tab 122 prevents first clip member 102 and second clip member 104 from completely separating from each other during installation or removal from a drop-down ceiling structure. Similarly, slide tang 108 of second clip member 104 also includes a tab 124 disposed on detent tang 112. Tab 124, as explained with respect to the tab 122 of the first clip member 102, engages detent tang 110 of slide tang 106 of first clip member 102, to prevent the first clip member 102 and the second clip member 104 from completely disengaging from each other during installation and/or removal.

In accordance with an aspect of the present invention, first clip member 102 of the adjustable clip 100 also includes a U shaped member 138*a* coupled to the arm 126 that extends from the second end 116 of the slide tang 106. The U shaped member 138*a* is substantially parallel to the longitudinal axis of the slide tang 106 of the first clip member 102. The aperture 130 suitably extends through the top portion of the U shaped member 138*a*, to allow the set-screw to engage the rail up which the clip is mounted. First clip member 102 of the adjustable clip 100 also includes a second U shaped member 138*b* coupled to an arm 154 extending on the same plane, but in the opposite direction of arm 126 disposed on the second end 116 of first clip member 102. U shaped member 138*b* is substantially parallel to the longitudinal axis of slide tang 106 of first clip member 102.

In accordance with an aspect of the present invention, second clip member 104 also includes a U shaped member 140*a* coupled to arm 132, which extends from the second end 120 of slide tang 108. U shaped member 140*a* is substantially parallel to the longitudinal axis of slide tang 108 of second clip member 104. Second clip member 104 of adjustable clip 100 further includes a second U shaped member 140*b* coupled to an arm 156 extending on the same plane, but in the opposite direction of arm 132 disposed on the second end 120 of the second clip member 104. The U shaped member 140*b* is also substantially parallel to the longitudinal axis of slide tang 108 of second clip member 104. Aperture 136 suitably extends through the top portion of the U shaped member 140*b*, enabling the set-screw to engage the structure upon which the clip is mounted.

As will be understood by those skilled in the art, the width of the U shaped members 138*a-b*, 140*a-b*, is suitably larger than the width of the structure upon which the clip is to be mounted, such as a T-rail, to engage it. It will be appreciated by those skilled in the art that the gap parallel extensions of the U shaped members 138*a-b*, 140*a-b*, i.e., the open end, for use with T-rails of common ceiling tile systems is suitably 0.09 inches in width apart. The skilled artisan will appreciate that the U shaped members 138*a-b*, 140*a-b*, are capable of employing gaps of different widths, without departing from the scope of the present invention.

As illustrated in FIG. 1, detent tang 110 of first clip member 102 includes a nipple 146 that lines up with one of three holes 152*a-c* on slide tang 108 of the second clip member 104 when the clip is at a predetermined corresponding width. Each of the three holes 152*a-c* corresponds to a predetermined T-rail width. Slide tang 106 of the first clip member 102 also includes three holes 150*a-c*, which correspond to a predetermined T-rail width. The predetermined T-rail widths for holes 150*a-c* and 152 *a-c* can match or be different corresponding width. In a preferred embodiment, when first clip member 102 and second clip member 104 are engaged, a nipple 148 on detent tang 112 of second clip member 104 lines up with one of the three holes 150*a-c* of the slide tang 106 of the first clip member 102 and engages the hole. The skilled artisan will appreciate that these nipples 146, 148, and holes 150*a-c* and 152*a-c* enable securing of the adjustable clip 100 at a distance corresponding to the width of the T-rail to which it is affixed.

Figure 3:
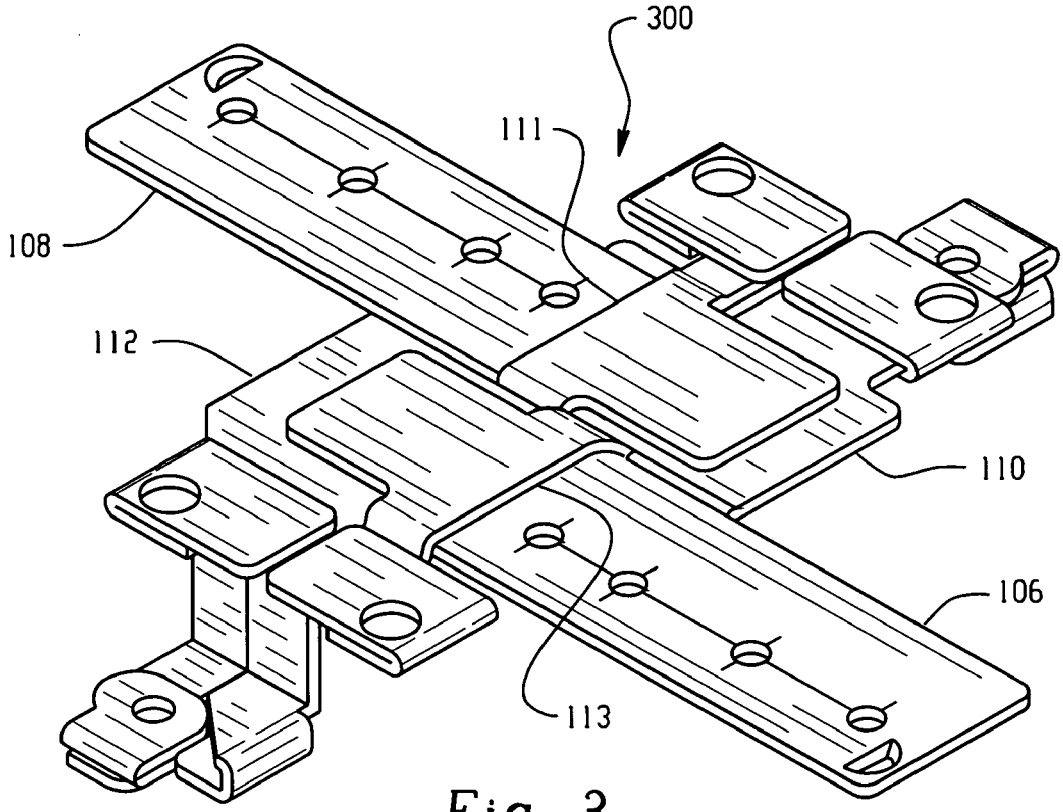
FIG. 3 illustrates the adjustable clip of FIG. 1 slideably engaged in accordance with the present invention.

Referring to FIG. 3, with continued reference to FIGS. 1 and 2, there is illustrated the adjustable clip 100 slideably engaged in accordance with an aspect of the present invention. Clip 100 is shown in a closed position 300, suitable for engaging a 9/16" T-rail, wherein slide tang 106 engages detent tang 112 via opening 113, and slide tang 108 engages detent tang 110 via opening 111.

Figure 4:
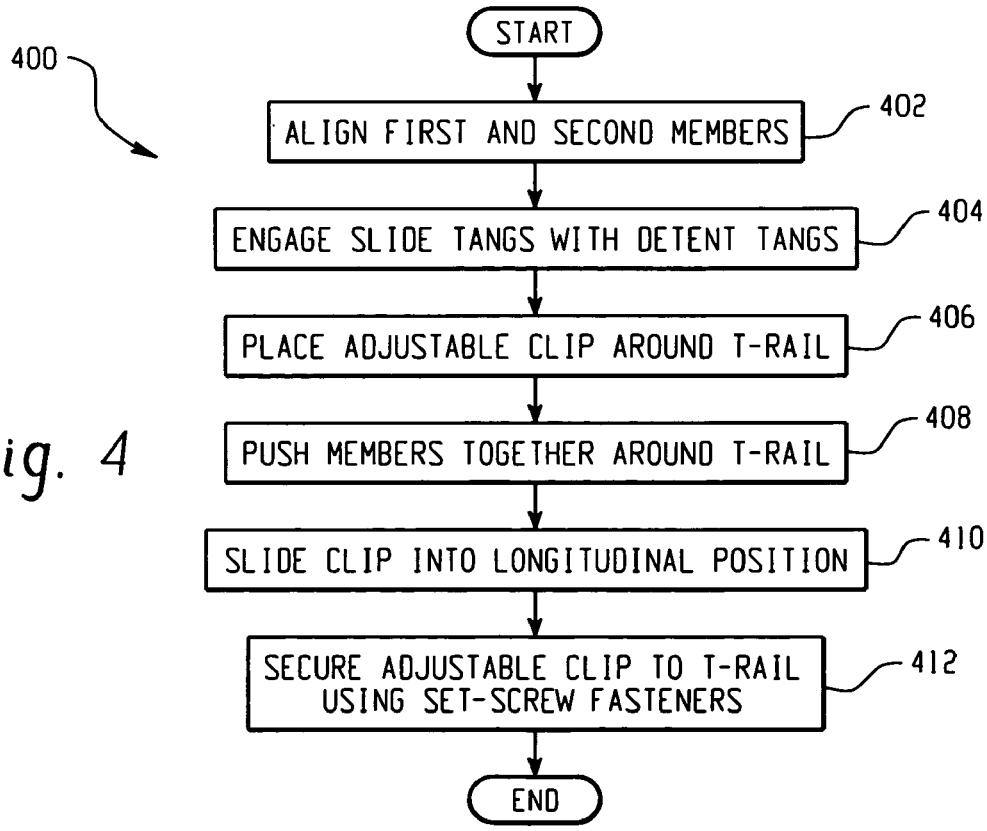
FIG. 4 illustrates a method in accordance with the present invention.

Turning now to FIG. 4, there is illustrated a flowchart 400 showing the method according to the present invention. Referring now to FIG. 5 with continued reference to FIGS. 1-4, there is illustrated several isometric views of the assembly and mounting of the clip 100 corresponding to various steps of method 400 of FIG. 4. Beginning at step 402, the first clip member 102 and the second clip member 104 are suitably aligned. The alignment of the first clip member 102 and the second clip member 104 is illustrated at 502 in FIG. 5A. Once aligned, with respect to each other, at step 404 of FIG. 4. the slide tangs 106, 108 are suitably engaged with the detent tangs 110, 112, respectively, as is illustrated at 504 in FIG. 5B. As will be understood by the skilled artisan, the slide tang 106 of the first clip member 102 engages the detent tang 112 of the second clip member 104 and the slide tang 108 of the second clip member 104 engages the detent tang 110 of the first clip member 102.

Figure 5A:
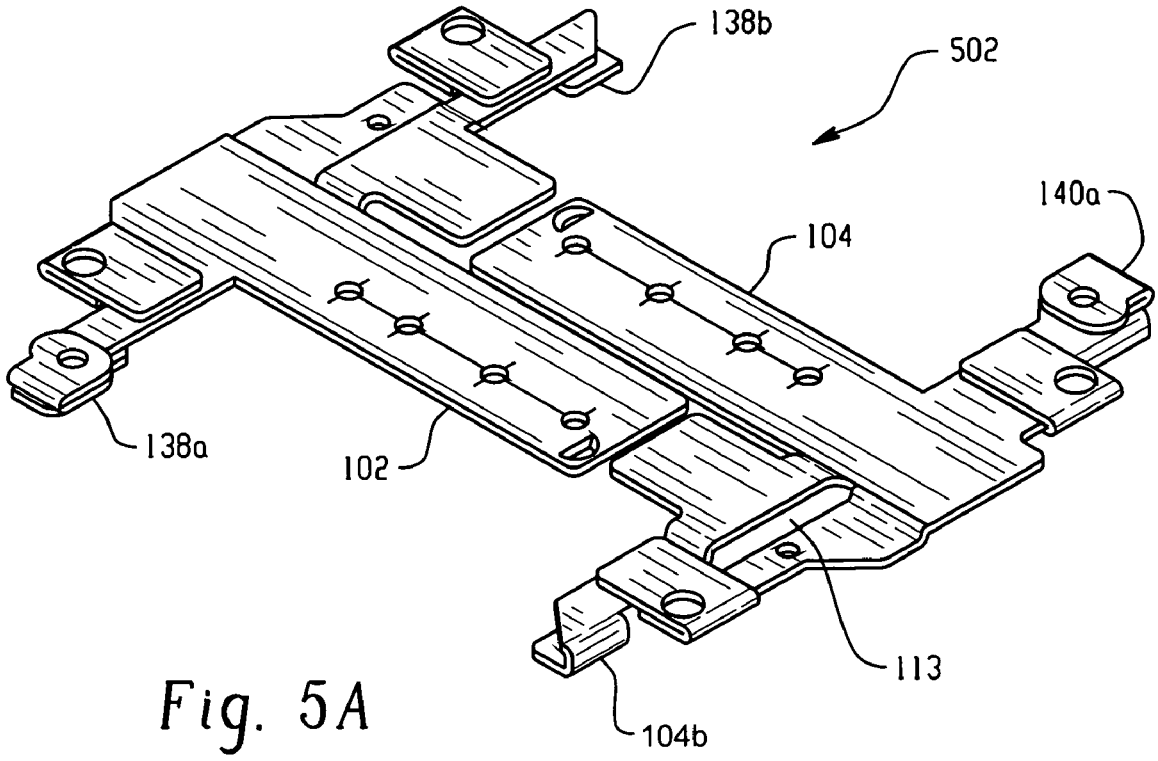
FIGS. 5A-5D illustrates the isometric assembly of the adjustable clip in accordance with the method of FIG. 4.
Figure 5B:
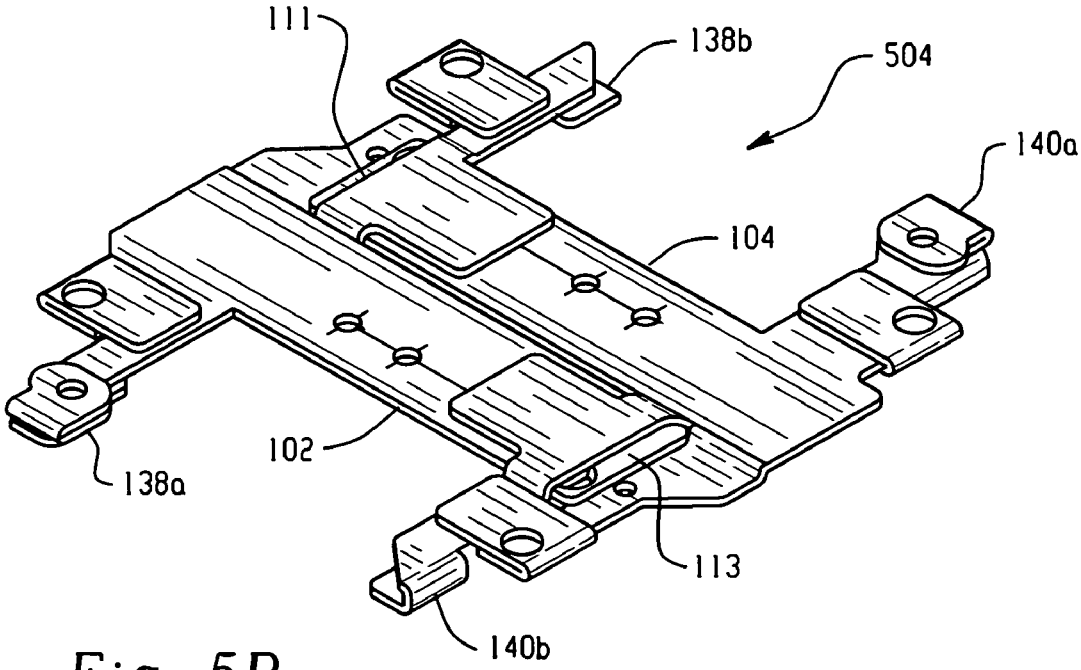
Figure 5C:
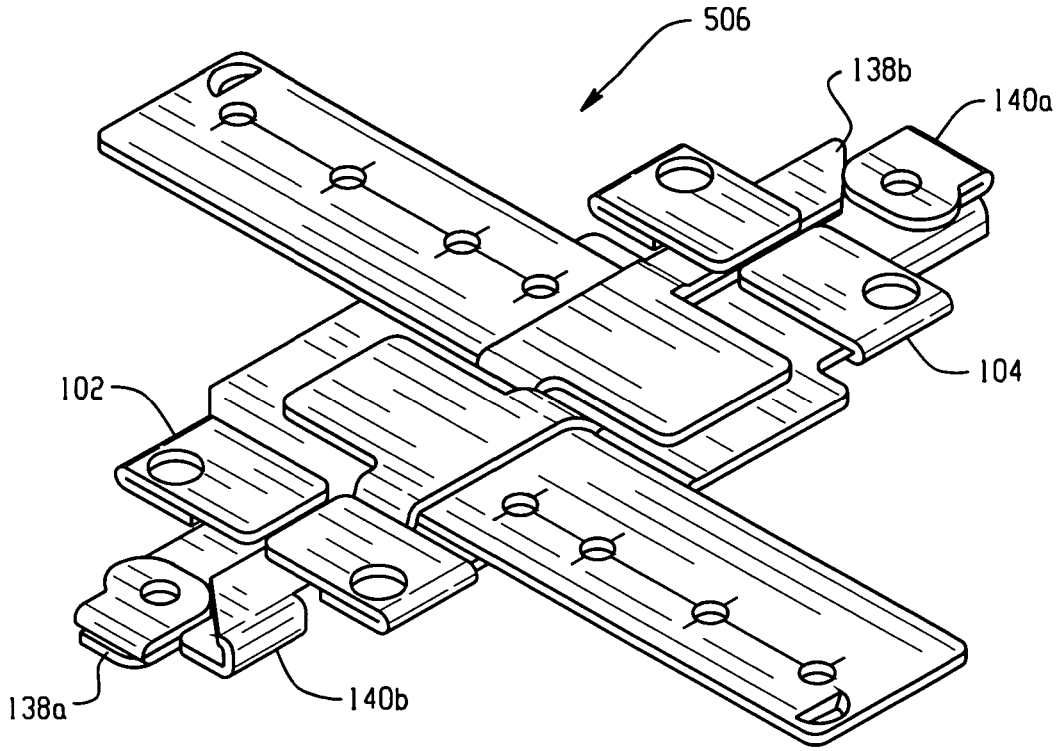

As previously addressed, tabs 122 and 124 prevent the slide tangs 106, 108 from disengaging from the detent tangs 110, 112. However, the skilled artisan will appreciate that the detent tangs 110, 112 are suitably flexed in order to push the ends of the slide tangs 106, 108 through the corresponding openings 111, 113 in detent tangs 110, 112 respectively. At step 406, the adjustable clip 100, in the fully extended position, is then placed around the T-rail (not shown). At step 408, the first clip member 102 and the second clip member 104 are then pushed together until their respective separation is equivalent to the width of the T-rail. In the preferred embodiment, nipples 146, 148 of detent tangs 110, 112 line up with one of the holes 150*a-c*, 152*a-c* on the slide tangs 106, 108. FIG. 5C illustrates the clip 100 in the engaged position 506 of step 408.

Figure 5D:
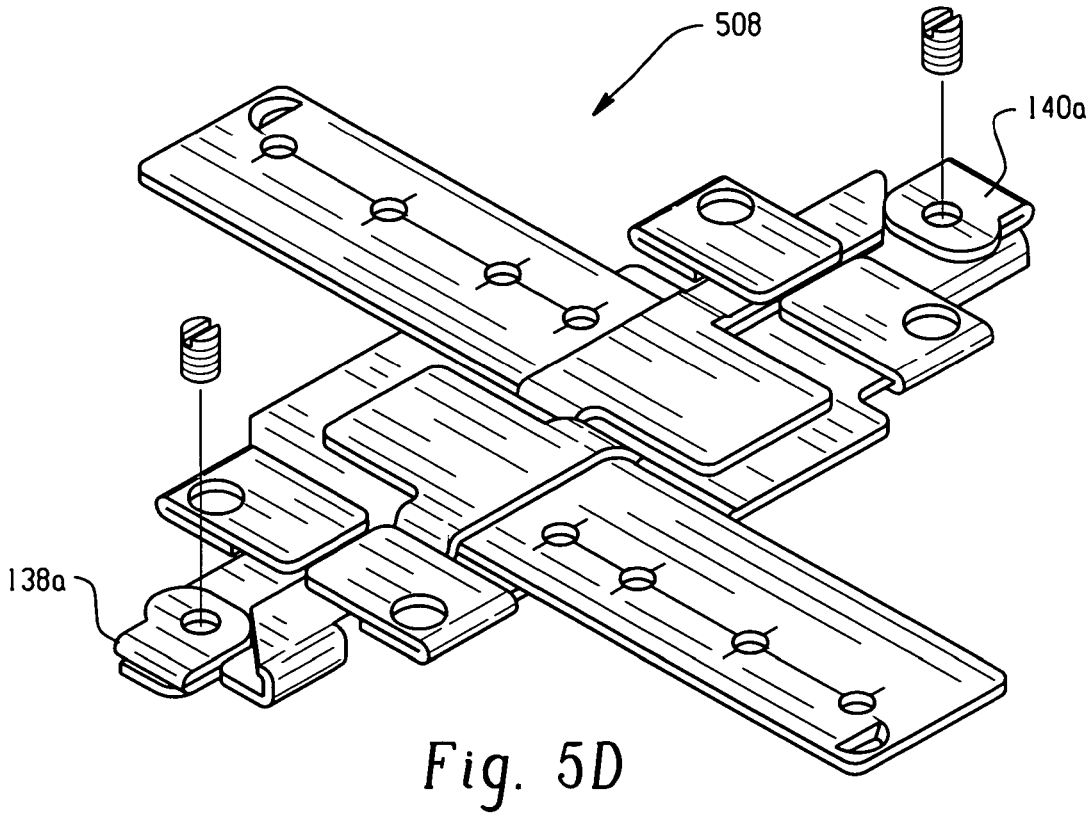

At step 410, the adjustable clip is suitably slid into position along the longitudinal axis of the T-rail. Once in the desired position, the set-screws in the apertures 130, 136 are secured to the T-rail at step 412, preventing movement along the longitudinal axis of the T-rail. FIG. 5D illustrates the insertion of the set-screws into the apertures 130, 136 when the clip is configured as shown at 508.

Figure 6:
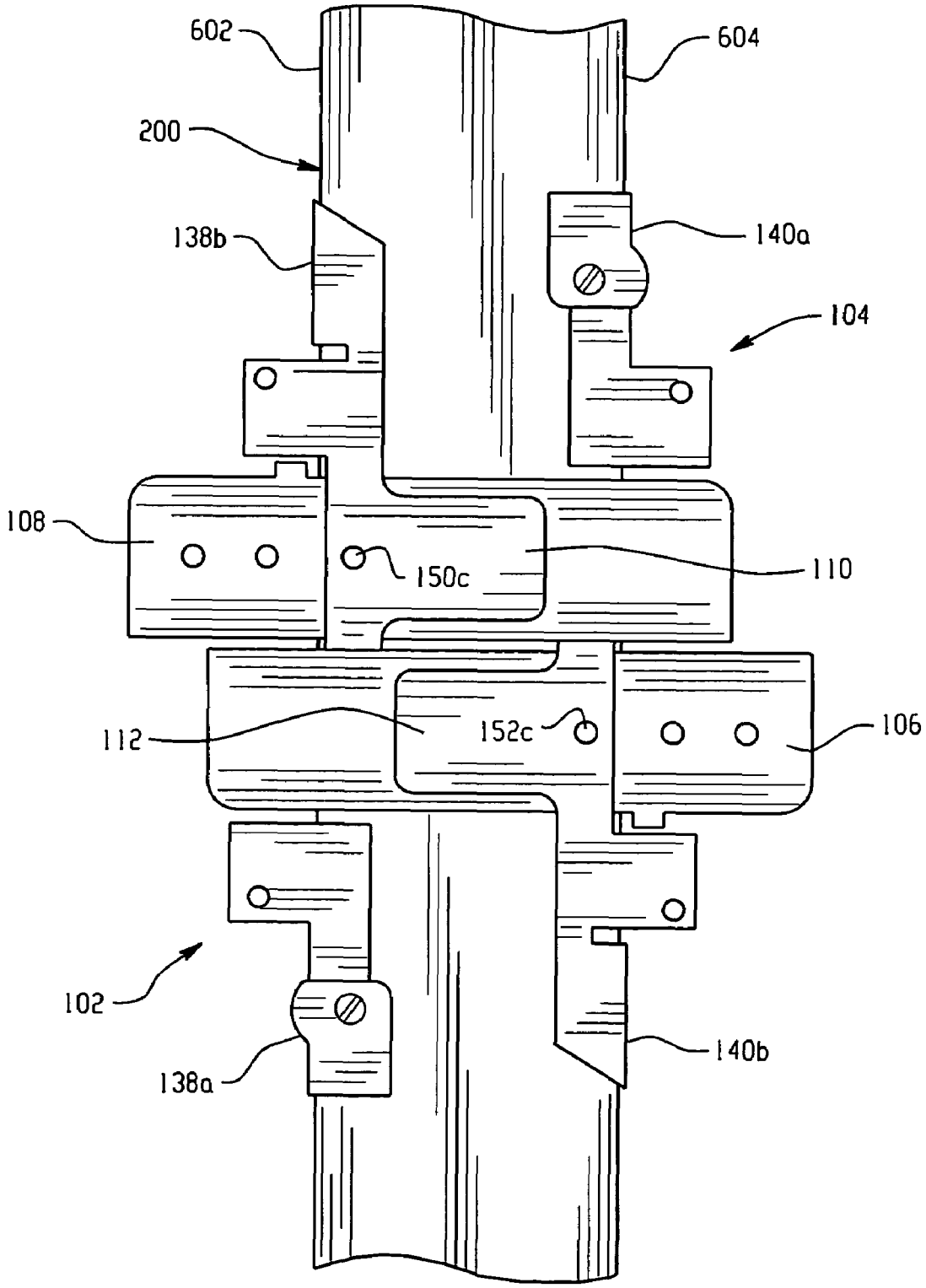
FIG. 6 illustrates the adjustable clip engaging a railing in accordance with an aspect of the present invention.
Figure 7C:
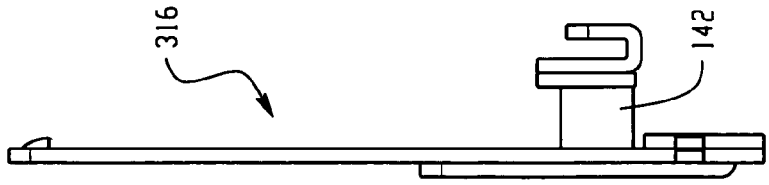
FIGS. 7A-7E illustrates an adjustable clip in accordance with an alternate embodiment of the present invention.
Figure 7B:
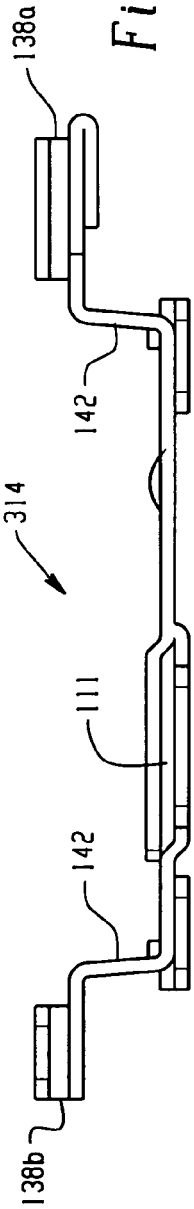
Figure 7A:
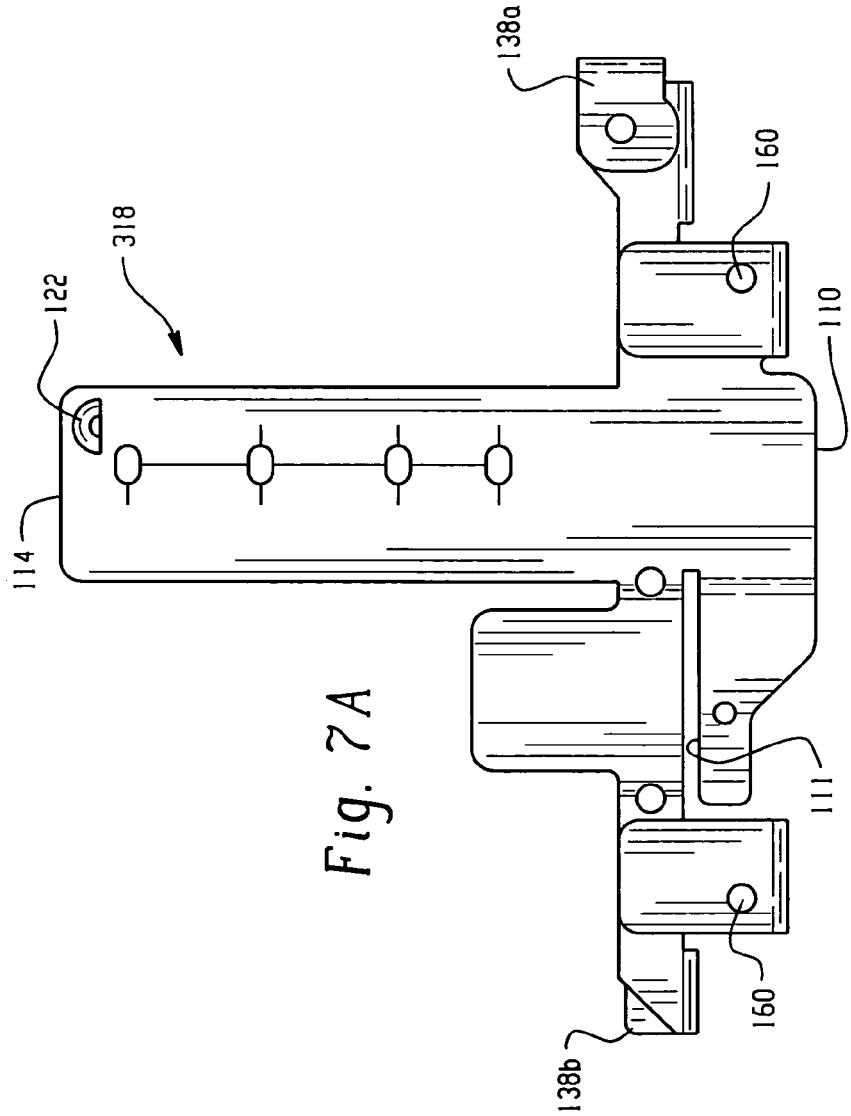
Figure 7D:
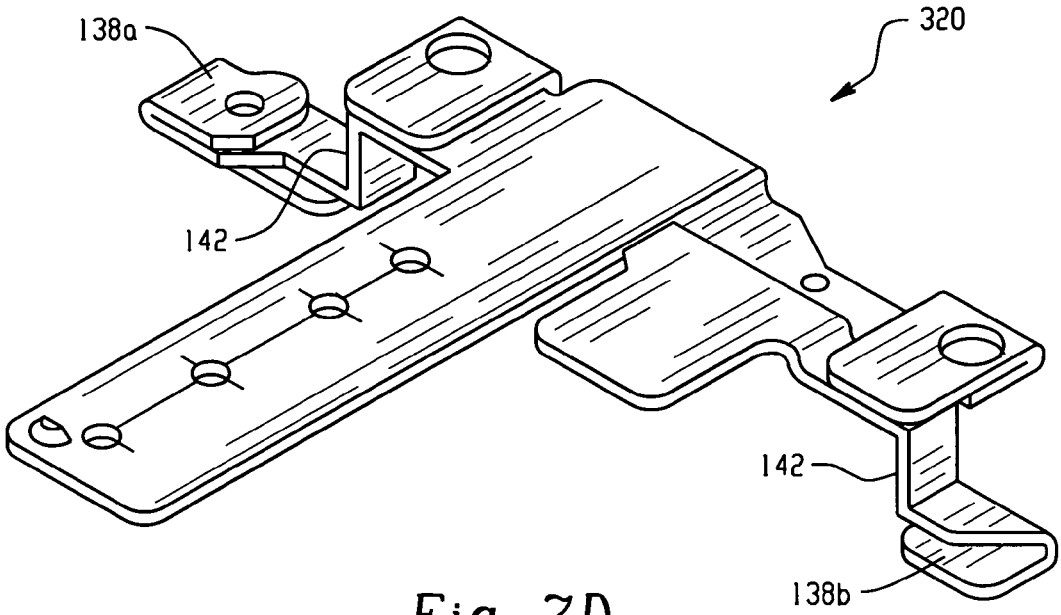
Figure 7E:
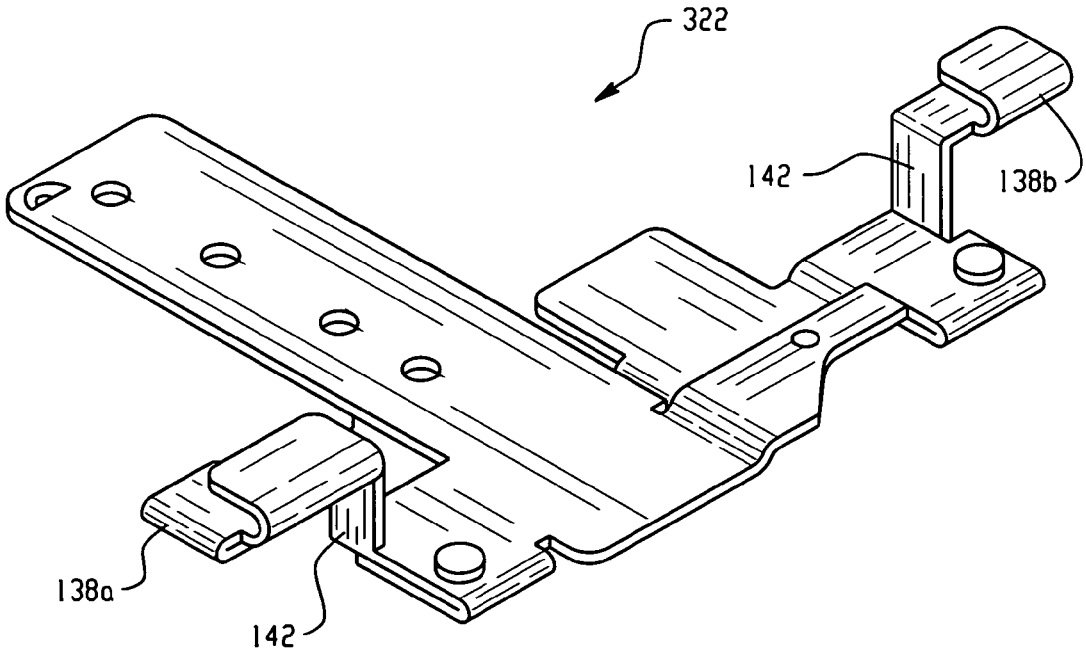

Referring now to FIG. 6, with continued reference to FIGS. 1-3, there is illustrated the adjustable clip 100 suitably engaged around a T-rail 200. FIG. 6 shows the slide tang 106 of the first clip member 102 is slideably engaged with the detent tang 112 of the second clip member 104. Likewise, the slide tang 108 of the second clip member 104 is slideably engaged with the detent tang 110 of the first clip member 102. As illustrated in FIG. 2, nipple 146 of detent tang 110 and nipple 148 of detent tang 112 are engaging holes 152*c* and 150*c*, respectively. The skilled artisan will appreciate that the first clip member 102 and the second clip member 104 are positioned at a length suitably capable of engaging the T-rail 200 of 1-½ inches in width. U shaped members 138*a*, 38*b* slide around and engage a first side 602 of T-rail 200 and U shaped members 140*a* and 140*b* slide around and engage the second (opposing) side 604 of T-rail 200. A set screw may be employed at one or both of apertures 130, 136 to prevent the clip from sliding along rail 200.

Referring now to FIG. 7, there is illustrated a clip member 700 suitable adapted for an alternate embodiment of an adjustable clip 100. As will be understood by those skilled in the art, the variety of ceiling tiles necessitates the employment of the offset adjustable clip 100. The preceding embodiment of adjustable clip 100 illustrated in FIGS. 1-3 is suitably employed by flush ceiling tiles, i.e., ceiling tiles having a flush surface with the T-rail. Other types of ceiling tiles, i.e., non-flush, offset or recessed ceiling tiles, are also employed in drop-down ceiling structures. These types of ceiling tiles, which extend downward, past the supporting T-rail, are suitable for use with adjustable clip 100 using clip member 700. As shown in FIG. 7, a distinction between the adjustable clip 700 and the adjustable clip 100 of FIG. 1 are the extended vertical arms 142 coupling the U shaped members 138*a*, 138*b* of first clip member 700. The skilled artisan will appreciate that the extended arms 142 enable flush mounting of first clip 700 with a similarly configured second clip (not shown) to an offset ceiling tile while remaining attached to the inset T-rail. The length of the extended arm 142 is suitably adapted to those offset lengths, i.e., lengths which the exposed face of the ceiling tile extends past the T-rail, known in the art. The skilled artisan will further appreciate that the function and remaining elements of the adjustable clip member 700 correspond to those of adjustable clip member 102 and need not be reiterated herein.

Figure 8:
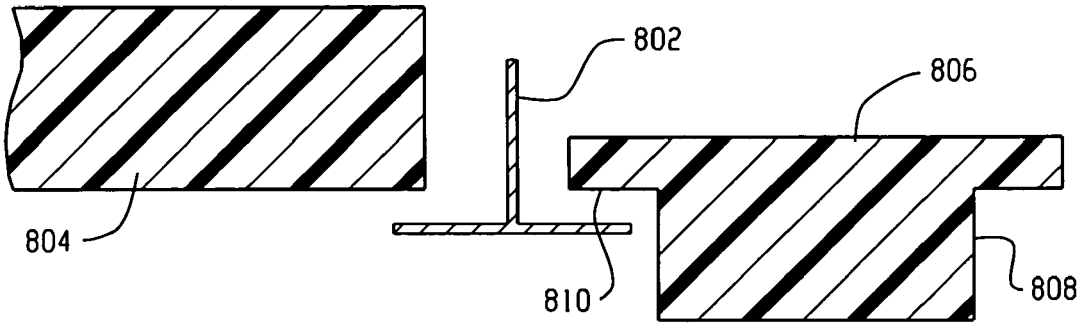
FIG. 8 illustrates ceiling tile structures suitably adapted for use with the clip of the present invention.

FIG. 8 shows an example of a T-rail 802 and ceiling tiles 804, 806 suitably adapted for use with clip 100 of the present invention employing either clip member 102 or clip member 700. Ceiling tile 804 is a standard flush mounting ceiling tile that rests upon T-rail 802. Ceiling tile 806 is a recessed ceiling tile, where surface 810 rests upon T-rail 802 and the bottom of the ceiling tile is offset from T-rail 802 a length substantially equivalent to the length of side 808 of ceiling tile 806.

Figure 9:
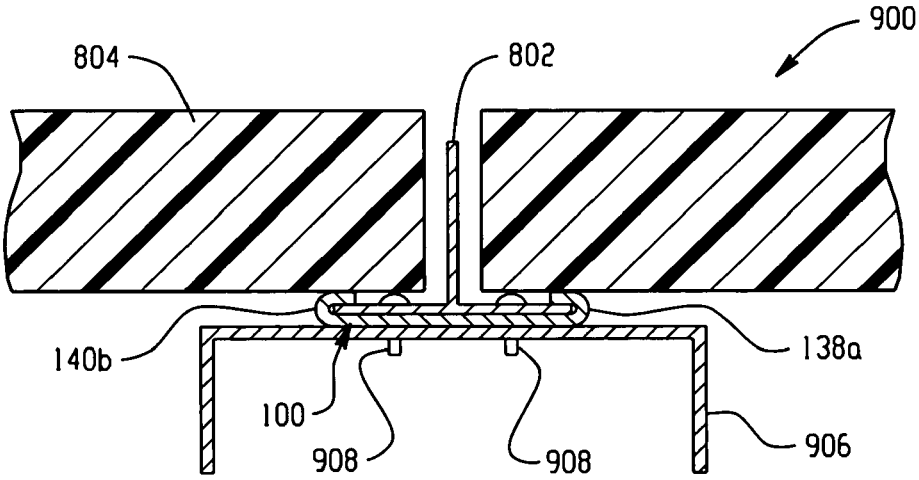
FIG. 9 illustrates a first embodiment of the clip of the present invention employed with a first style of ceiling tiles.

Referring now to FIG. 9, there is illustrated a ceiling tile system 900 suitably adapted for use with a clip 100 in accordance to one embodiment of the present. invention. Ceiling tiles 804 rest on rails of T-rail 802. U shaped members 138 and 140 of clip members 102 and 104 engage the rails of T-rail 802. A device 906 is fastened to clip 100 via fasteners 908. For example fasteners can be employed in mounting holes 160 of clip 100. This embodiment of clip 100 using clip members 102 and 104 enables device 906 to be mounted substantially flush with ceiling tiles 804.

Figure 10:
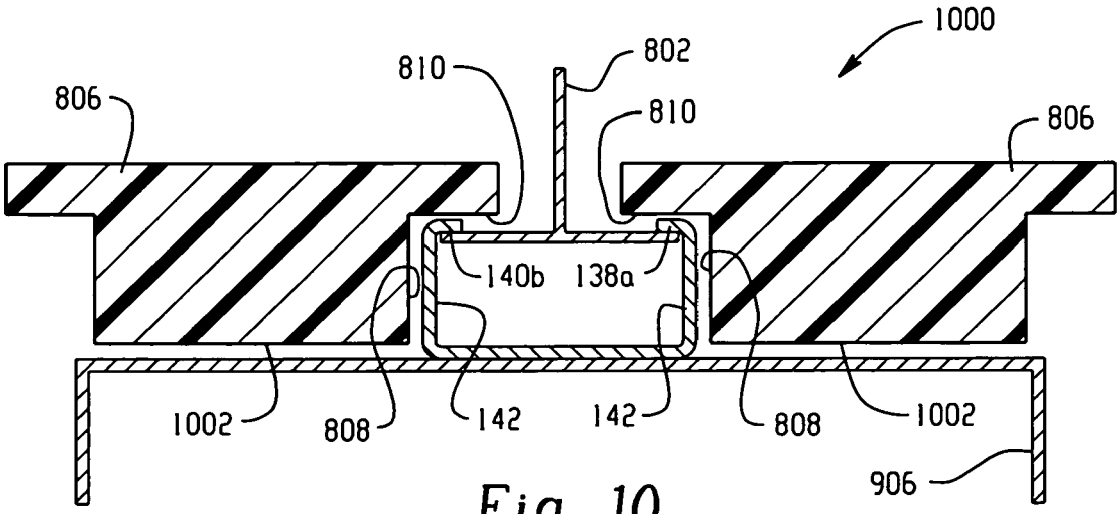
FIG. 10 illustrates an alternative embodiment of the present invention employed with a second style of ceiling tiles.

Referring now to FIG. 10, there is illustrated a ceiling tile system 1000 suitably adapted for an alternative embodiment of the present invention. For this embodiment, clip 100 is formed using two clip members configured similar to clip members 700 with vertical arms 142. Ceiling tiles 806 rest upon T-rail 802. As ceiling tiles 806 are offset style ceiling tiles, the bottom 1002 of the tiles 806 are situated below T-rail 802 a length substantially equal to the length of sides 808. The length of arms 142 are of suitable length corresponding to the length of sides 808. Thus, when device 906 is fastened to clip 100 via fasteners 908, device 906 is substantially flush with the bottom surfaces 1002 of tiles 806.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. An adjustable clip, comprising:

a first clip member, the first clip member comprising a slide tang having a first end and a second end, and a detent tang with an opening disposed on the second end of the slide tang, the detent tang further comprising a nipple; and a second clip member, the second clip member comprising a slide tang having a first end and a second end, the slide tang further comprising a hole, and a detent tang with an opening disposed on the second end of the slide tang;

wherein the first end of the slide tang of the first clip member engages the opening of the detent tang of the second clip member and the first end of the slide tang of the second clip member engages the opening of the detent tang of the first clip member; and wherein the hole in the slide tang of the second clip member aligns with the nipple of the detent tang of the first clip member when the clip is at a predetermined width.

2. The adjustable clamp of claim 1, further comprising:

the detent tang of the second clip member further comprising a nipple; and the slide tang of the first clip member further comprising a hole;

wherein the hole in the slide tang of the first clip member aligns with the nipple of the detent tang of the second clip member when the clip is at a predetermined width.

3. The adjustable clamp of claim 1, further comprising the slide tang of the first clip member having a plurality of holes, wherein each hole aligns with, and engages, the nipple of the detent tang of the second clip member at a corresponding predetermined width.

4. The adjustable clamp of claim 3, further comprising the slide tang of the second clip member having a plurality of holes, wherein each hole aligns with the nipple of the detent tang of the first clip member at the corresponding predetermined width.

5. The adjustable clip of claim 1, further comprising:

a first tab disposed on the first end of the slide tang and a second tab disposed on the first end of the second slide tang;

wherein the first tab prevents the slide tang of the first clip member from disengaging the detent tang of the second clip member and the second tab prevents the slide tang of the second clip member from disengaging the detent tang of the first clip member.

6. The adjustable clip of claim 1, further comprising the first clip member further comprising an arm protruding from the detent tang, a tab connected to the arm, and the tab further comprising an aperture; and the second clip member further comprising an arm protruding from the detent tang, a tab connected to the arm, and the tab further comprising an aperture.

7. The adjustable clip of claim 6, further comprising:

the aperture of the first clip member having threads for receiving a threaded fastener; and the aperture of the second clip member having threads for receiving a threaded fastener.

8. The adjustable clip of claim 1:

wherein the detent tang of the first clip member is offset from the slide tang of the first clip member such that the slide tang of the second clip member is adjacent to the slide tang of the first clip member when the first clip member is engaged with the second clip member; and wherein the detent tang of the second clip member is offset from the slide tang of the second clip member such that the slide tang of the second clip member is adjacent to the slide tang of the first clip member when the first clip member is engaged with the second clip member.

9. The adjustable clip of claim 1, further comprising:

a U shaped member extending from the detent tang of the first clip member such that the U shaped member is oriented substantially parallel to the longitudinal axis of the slide tang of the first clip member; and a U shaped member extending from the detent tang of the second clip member such that the U shaped member is oriented substantially parallel to the longitudinal axis of the slide tang of the first clip member;

wherein when the adjustable clip engages a rail, the U shaped member of the first clip member and the U shaped member of the second clip member grip opposing ends of the rail.

10. The adjustable clip of claim 9, further comprising:

a vertical arm coupling the U shaped member of the first clip member to the detent tang of the first clip member; and a second vertical arm coupling the U shaped member of the second clip member to the detent tang of the second clip member.

11. An adjustable clip, comprising:

a first clip member, the first clip member comprising a slide tang having a first end and a second end, and a detent tang disposed on the second end of the side tang;

a second clip member, the second clip member comprising a slide tang having a first end and a second end, and a detent tang disposed on the second end of the side tang;

a first tab disposed on the first end of the first slide tang and a second tab disposed on the first end of the second slide tang;

a U shaped member extending from the detent tang of the first clip member such that the U shaped member is substantially parallel to the longitudinal axis of the slide tang of the first clip member;

a U shaped member extending from the detent tang of the second clip member such that the U shaped member is substantially parallel to the longitudinal axis of the slide tang of the first clip member;

a vertical arm coupling the U shaped member of the first clip member to the second end of the slide tang of the first clip member; and a second vertical arm coupling the U shaped member of the second clip member to the second end of the slide tang of the second clip member;

wherein the first end of the slide tang of the first clip member engages the detent tang of the second clip member and the first end of the slide tang of the second clip member engages the detent tang of the first clip member;

wherein the first tab prevents the slide tang of the first clip member from disengaging the detent tang of the first clip member and the second tab prevents the slide tang of the second clip member from disengaging the detent tang of the first clip member;

wherein the U shaped member extending from the second end of the slide tang of the first clip member is adapted to engage one side of a T-rail;

wherein the U shaped member extending from the second end of the slide tang of the second clip member is adapted to engage the opposing side of the T-rail;

wherein the detent tang of the second clip member further comprising a nipple; and wherein the slide tang of the first clip member having a plurality of holes, wherein each hole aligns with the nipple of the detent tang of the second clip member at a corresponding predetermined width.

12. The adjustable clip of claim 11, further comprising:

the detent tang of the first clip member further comprising a nipple; and the slide tang of the second clip member having a plurality of holes, wherein each hole aligns with the nipple of the detent tang of the first clip member at the corresponding predetermined width.

* * * * *